United States Patent [19]

Mathews

[11] 4,202,499

[45] May 13, 1980

[54] SWIMMING POOL CLEANER

[76] Inventor: Lester R. Mathews, 9810 N. 37th St., Phoenix, Ariz. 85028

[21] Appl. No.: 843,870

[22] Filed: Oct. 20, 1977

[51] Int. Cl.[2] ..... B05B 3/06

[52] U.S. Cl. ..... 239/206; 4/172.15; 134/167 R

[58] Field of Search ..... 239/205, 206, 132.5; 134/167 R, 168 R, 176, 179; 4/172, 172.15, 172.16, 172.17

[56] References Cited

U.S. PATENT DOCUMENTS

| | | | |
|---|---|---|---|
| 575,966 | 1/1897 | Main | 239/240 |
| 2,756,099 | 7/1956 | Reynolds, Jr. | 239/240 |
| 3,107,056 | 10/1963 | Hunter | 239/206 |
| 3,675,252 | 7/1972 | Ghiz | 4/172.17 |
| 3,785,565 | 1/1974 | Perry et al. | 239/206 |
| 3,854,664 | 12/1974 | Hunter | 239/206 |
| 3,868,732 | 3/1975 | Engelhart | 4/172 |

*Primary Examiner*—John J. Love
*Assistant Examiner*—Michael J. Forman

[57] ABSTRACT

A pop-up swimming pool cleaner comprising a cleaner for a swimming pool having a floor formed with an opening therein, said cleaner comprising a nipple that is positioned within the opening and clamped to the bottom wall. This nipple is internally threaded and screwed thereinto is the top wall of a gear housing. This top wall is formed with a central opening in which is journaled a tube which opens at its upper end into a vertical arm of an L-shaped passage and the lower end of which is splined. The gear housing includes an outer cylindrical wall and a bottom wall. It also includes an inner cylindrical wall extending between the top and bottom walls, and an annular wall spaced from the top wall defines a chamber for a rotor having a central tubular member extending into the inner cylindrical wall of the gear housing. This member has interior splines at its lower end and the tube which extends through the top wall also extends into this tubular member and is formed with external splines, with the rotor and tube being formed with abutment means for limiting axial movement of the splined tube. The rotor includes an internally toothed ring gear and meshing therewith is a pinion above the annular wall. This ring gear constitutes the upper end of a reduction gear train.

1 Claim, 6 Drawing Figures

SWIMMING POOL CLEANER

The present invention relates to swimming pool cleaners and is concerned primarily with a cleaner which is of plastic and clamped to the underside of the pool floor and provides mechanism for lifting a get block above the pool floor to expose an outlet opening therein, rotating the block, and at the same time ejecting water from the opening under pressure as a jet, all of which operations are performed by water under pressure coming from a suitable source of supply.

BACKGROUND OF THE INVENTION

At the present time, the installation of home swimming pools is becoming more and more widespread. Many of these pools are made of cement and great difficulty has been experienced in cleaning the bottom walls thereof while water is in the pool. However, of recent years the use of plastic swimming pools is becoming more and more widespread. All plastic swimming pools include a flat bottom and the present invention is concerned primarily with the provision of a swimming pool cleaner which may be clamped in an opening formed in the bottom of the pool and which provides mechanism for raising a jet block from a position in which it is substantially flush with the floor to one in which it delivers a horizontal jet and rotating the block all under the pressure of water from an appropriate source of supply.

While there are examples in the art of sprinklers for grass lawns in which a nozzle is oscillated between fixed limits and is raised above the lawn level by water under pressure from a suitable source, there are certain features of such a device which are undesirable if an attempt is made to use it as a pool cleaner. Among such undesirable features is the fact that the reduction gear train of the sprinkler must be packed in grease. Moreover, oscillating the jet nozzle requires mechanism that is more complex than is mechanism which provides for rotation of such a nozzle through a full 360 degrees. Then again, the sprinkler is not adapted to be mounted in a secure position below the ground surface as compared to clamping it to the floor of a swimming pool. Nearly all the parts of the lawn sprinkler are metal and particularly the gear train which must be packed in grease to maintain its service life. All of these difficulties are avoided in the pool cleaner of the present invention.

OBJECTS OF THE INVENTION

With the foregoing conditions in mind, the present invention has in view the following objectives:

1. To provide a swimming pool cleaner that is particularly adapted for use with a plastic swimming pool having a bottom floor with an opening therein, with the cleaner being clamped to the bottom floor at and within said opening.

2. To provide a swimming pool cleaner of the type noted which is powered by a source of water under pressure.

3. To provide a swimming pool cleaner which includes a cylindrical jet block having a cylindrical surface and formed with an L-shaped passageway therein, one arm of which opens onto said cylindrical surface, together with mechanism which is energized by said water pressure to raise the block above the level of said pool floor to expose the open end of said passage.

4. To provide a swimming pool cleaner of the kind described which includes means for rotating said jet block through a full 360 degrees under the pressure of said water supply.

5. To provide a swimming pool cleaner of the character aforesaid in which said means for rotating the jet block comprises a turbine having an impeller which is operatively connected to one end of a reduction gear train and the other end of which is drivably connected to a ring gear on a rotor.

6. To provide a swimming pool cleaner of the kind described in which substantially all of the parts are of plastic and with means to lubricate the reduction gear train by water from said source.

Various other more detailed objects and advantages of the invention such as arise in connection with carrying out the above-noted ideas in a practical embodiment will in part become apparent and in part be hereinafter stated as the description of the invention proceeds.

SUMMARY OF THE INVENTION

The foregoing objects are achieved by providing a cleaner for a plastic swimming pool having a circular opening in its floor and which cleaner is clamped to said floor at and within said opening by a plastic nipple having a flange on its upper end which engages the upper surface of the floor and a nut which is screwed onto the nipple below the floor and tightened against a gasket interposed between the nut and the floor. Screwed onto the lower end portion of the nipple is a coupling which is connected to a conduit coming from an appropriate source of water under pressure. The nipple is also internally threaded and screwed into these internal threads is a top wall of a gear housing that is comparatively thick and formed with recesses entering into its upper face and an axial bore which receives a tubular extension from the upper side of a rotor.

Depending from this top wall and preferably integral therewith is a sleeve constituting the cylindrical wall of the gear housing and having a bottom wall at its lower end formed with a central bearing opening and water inlets. The rotor also includes a tubular depending member of larger diameter than the upwardly extending tubular part, with an annular shoulder between these parts. The lower end portion of the depending tubular member is formed with internal splines. A tube having an enlarged lower end portion that is externally splined meshes with the internal splines on the tubular extension of the rotor and an annular shoulder which cooperates with the first-mentioned annular shoulder to limit upward movement of this tube.

The upper end of the tube is externally threaded and screwed into a socket that opens onto the lower face of a cylindrical jet block. This jet block has a cylindrical surface. An L-shaped passageway has a vertical arm which communicates with the tube end which is screwed into the socket and a horizontal arm which opens onto the cylindrical surface of the jet block.

Positioned in one of the recesses in the top wall of the gear housing is an expansion coil spring, the upper end of which engages the jet block to limit inward movement thereof and thus prevent jamming.

The gear housing includes a ring-like wall spaced from the top wall and integrally joined to the cylindrical wall of the housing. This ring-like wall defines a circular aperture through which a duct extends from a point spaced from the top wall to the bottom wall of the housing. This duct is integral with the ring-like wall and receives the lower tubular extension of the rotor.

The rotor comprises an annular wall from which depends a skirt that is formed with internal teeth whereby it is constituted a ring gear. A pinion meshes with this ring gear and is carried at one end of a shaft that passes through an opening in the ring-like wall and constitutes one end of a reduction gear train. The duct is formed with an orifice in the area in which the gear train is located. Depending from the bottom wall of the gear housing is a turbine casing including a cylindrical wall formed with tangential water inlets. Positioned within this casing is an impeller having blades on which water from said inlets impinge. This impeller is drivably mounted at one end of a shaft that is journaled in the bearing opening of the bottom wall and the upper end of which drivably carries a gear constituting the lower end of the gear train.

A screen comprises a cylindrical portion that is suspended from the top wall of the gear housing and is spaced from the cylindrical wall thereof and also from the bores of the nipple and conduit and a lower wall which is spaced from the impeller. In operation, water under pressure from the source passes through both the cylindrical and bottom walls of the screen into the space about the turbine casing. It then passes through the water inlets thereof and impinges on the blades of the impeller to rotate it and the gear thereabove, which constitutes one end of the reduction gear train. This water after it leaves the turbine is still under pressure and passes upwardly in the duct to, in the first instance, engage the lower end of the splined tube and force the latter to its upper limit of movement as determined by the shoulders and thus raises the jet block into a position in which the open end of the horizontal arm of the L-shaped passage is exposed above the floor surface of the pool. It is held in this position as long as there is water pressure against the lower end of the splined tube. Some of the water passes through the passage in the duct to the reduction gear train for lubrication purposes. The gear train is effective through the ring gear of the rotor to rotate the latter and the jet block through a full 360 degrees.

For a full and more complete understanding of the invention, reference may be had to the following description and accompanying drawings, wherein.

DESCRIPTION OF A PREFERRED EMBODIMENT

Figure 3:
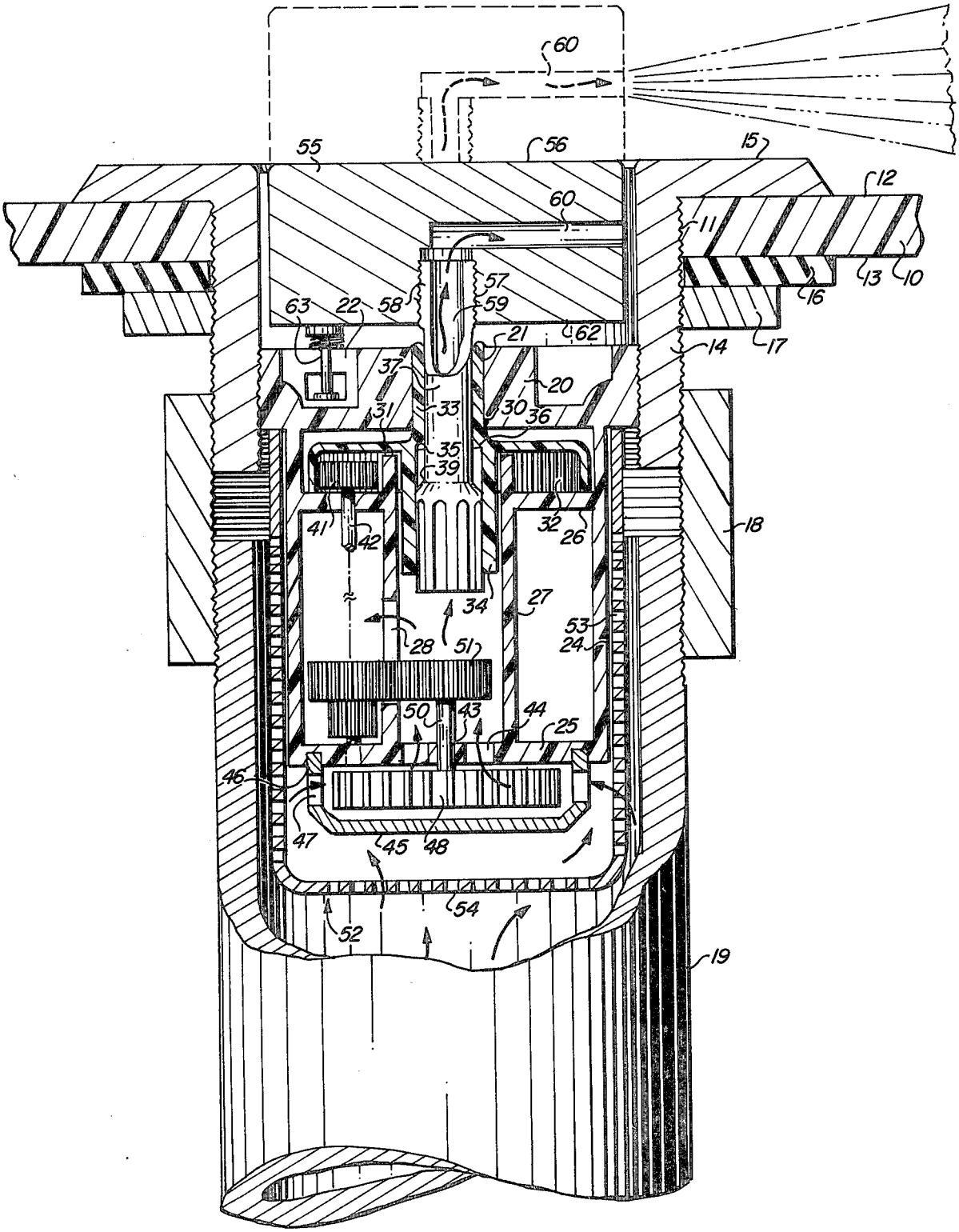
FIG. 3 is a vertical section through a portion of the floor of a swimming pool formed with an opening therein and with the pool cleaner of this invention mounted within said opening and clamped to the pool floor.

Referring first more particularly to FIG. 3, the floor of a plastic swimming pool is shown at 10. It is formed with a threaded circular opening 11, has an upper surface 12 and a bottom surface 13. A nipple 14 has an annular flange 15 at its upper end which engages surface 12 as it is screwed into opening 11. A gasket 16 is positioned about nipple 14 and pressed against pool surface 13 by a nut 17 which is threaded onto nipple 14.

Figure 1:
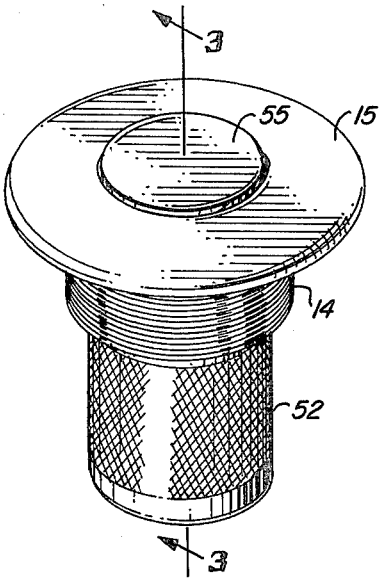
FIG. 1 is a perspective of a swimming pool cleaner designed in accordance with the precepts of this invention.
Figure 2:
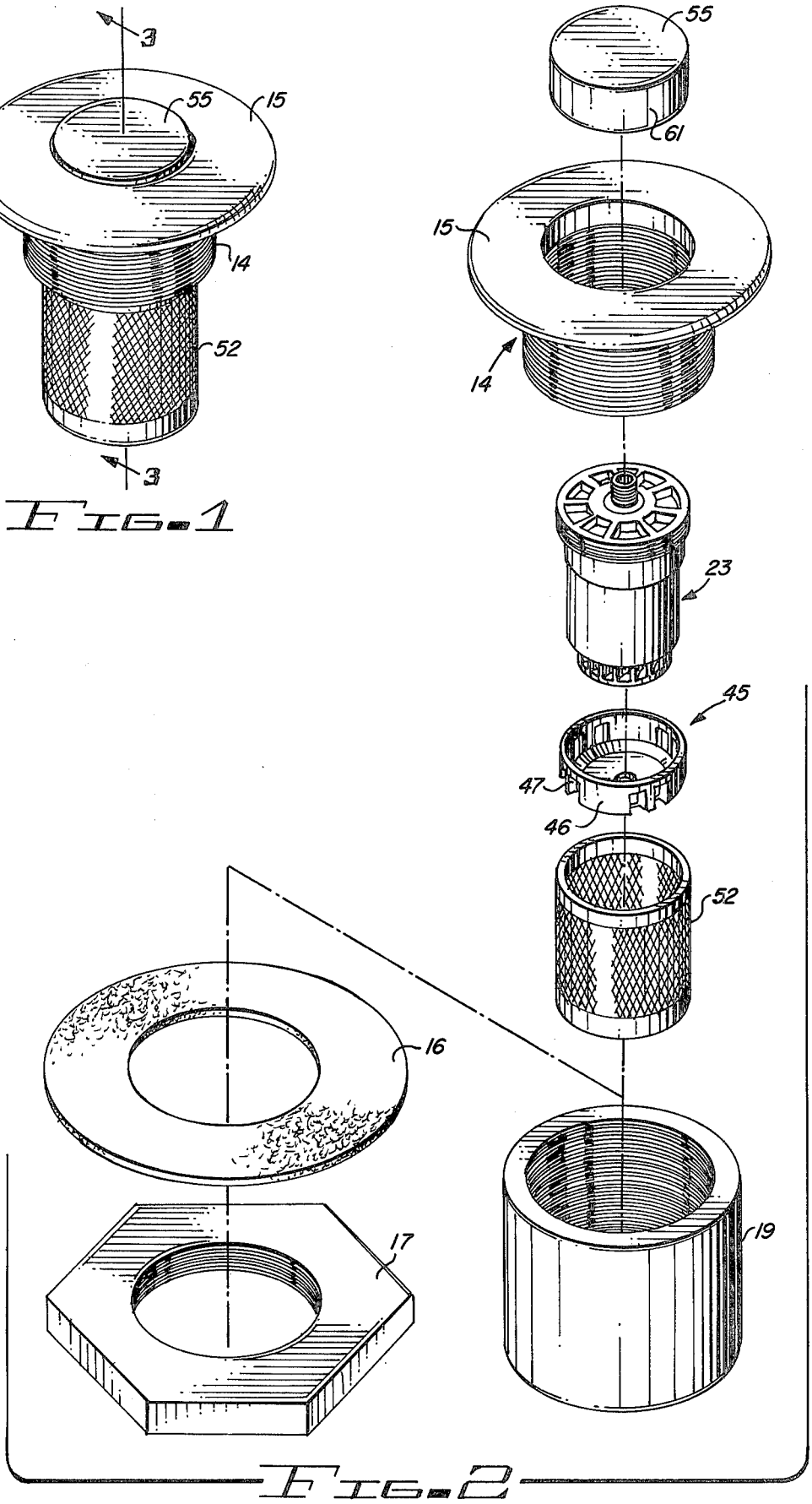
FIG. 2 is a perspective illustrating the elements of the cleaner of FIG. 1 in exploded relation.

Also threaded onto the nipple 14 is a coupling 18, the lower end of which is connected to a conduit 19 which extends to a source of water under pressure. The bore of nipple 14 is also threaded, and screwed thereinto is a thick disk 20 constituting the top wall of a gear housing. Disk 20 is formed with a central aperture 21 which functions as a bearing as will be later described and has a plurality of recesses 22 opening onto its upper face. A gear housing is identified generally at 23 (FIG. 2) and comprises an outer cylindrical wall 24 which depends from top wall 20 and a bottom wall 25. Walls 20, 24, and 25 are preferably an integral unit. A ring-like partition or member 26 has its peripheral edge integrally joined to cylindrical wall 24, with its inner edge defining an aperture which receives a duct 27. The upper end of duct 27 is spaced from top wall 20 and its lower edge is integrally joined to bottom wall 25. This duct 27 has an orifice 28 therein for a purpose to be later described.

Figure 4:
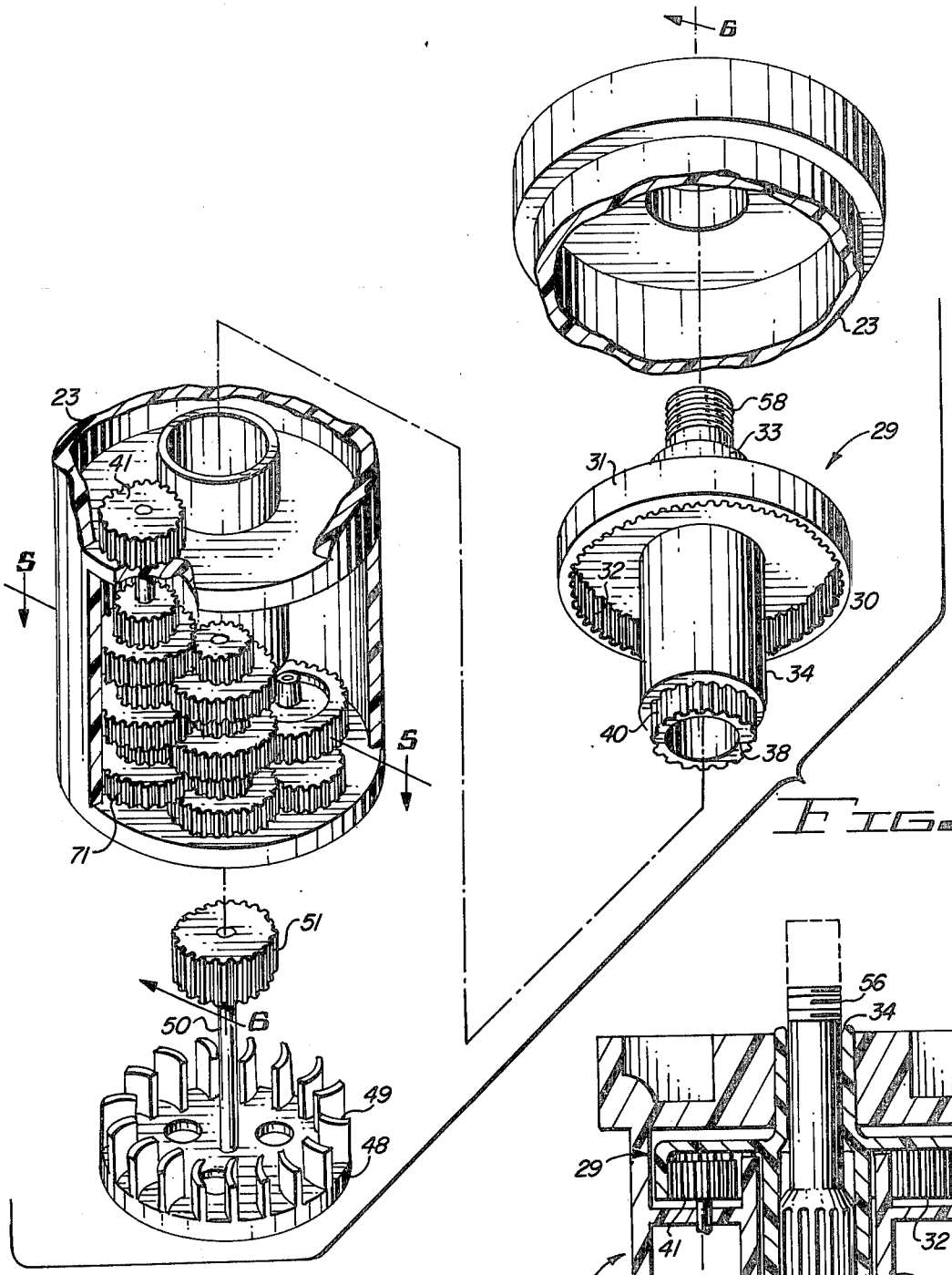
FIG. 4 is a perspective depicting the impeller, gear housing, and rotor in exploded relation.

Referring now to FIG. 4, which may be considered along with FIG. 3, a rotor is identified in its entirety by the reference character 29. It comprises an annular member 30 from which depends a skirt 31 formed with internal gear teeth 32 whereby it is constituted a ring gear. Member 30 is formed with an upwardly extending tubular extension 33 which is rotatably received in aperture 21 and a lower tubular extension 34 of larger diameter than extension 33, thus providing an annular shoulder 35 between these two tubular extensions. A tube, identified generally at 36, has an upper portion 37 that is snugly received in extension 33 and a lower portion 38 that is received in lower extension 34. An annular shoulder 39 is located between these upper and lower portions and constitutes an abutment which cooperates with shoulder 35.

Lower extension 34 is internally splined (not illustrated) and the lower end portion of tubular part 38 is formed with external splines 40 which mesh with these internal splines. Thus, a driving relation is established between tube 36 and rotor 29 but relative axial movement is permitted between these members but limited by shoulders 35 and 39.

As shown in FIG. 3, a gear 41 meshes with ring gear 32 and is drivably mounted on the upper end of a shaft 42 journaled in partition 26 and constitutes the end of a reduction gear train, to be later described.

Bottom wall 25 of the gear housing is formed with a central bearing opening 43 and water inlets 44. A turbine casing 45 depends from and is connected to bottom wall 25 and has a cylindrical wall 46 formed with tangential water inlets 47. An impeller 48 (see FIG. 4) includes blades 49 and is drivably mounted on the lower end of a shaft 50 which is journaled in bearing opening 43. A gear 51 is drivably mounted on the upper end of shaft 50 and constitutes the other end of the reduction gear train, to be later described.

A screen is shown at 52 and includes a cylindrical wall 53, the upper end of which is anchored to top wall 20 of the disk housing but in spaced relation to the cylindrical wall 24 thereof and also in spaced relation to the bores of nipple 14 in conduit 19. Screen 52 also includes a bottom wall 54 that is spaced from turbine casing 45. A cylindrical jet block 55 is positioned within the upper end of the bore of nipple 14 and, when the cleaner is not in use, has an upper face 56 which is substantially flush with the upper face of flange 15. Jet block 55 is formed with a threaded socket 57 into which is screwed the upper end portion 58 of tube 36. This tube 36 has a bore 59 which is in communication with the horizontal arm 60 which, together with socket 57, constitutes an L-shaped passage in jet block 55. The open end of passage arm 60 is shown at 61. Jet block 55 has a lower face 62 which is normally spaced above top wall 20 of the gear housing and maintained in this position by a spring-biased pin 63 positioned in one of the recesses 22. This spring-biased pin prevents jamming of the parts when water pressure is discontinued and jet block 55 and rotor 29 fall down under gravity action.

Figure 5:
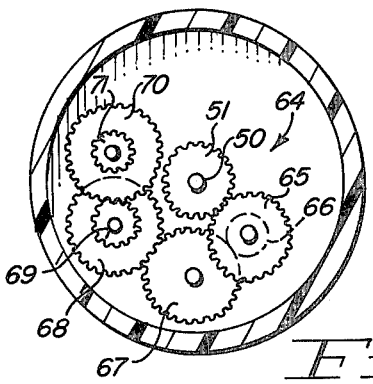
FIG. 5 is a detailed longitudinal section showing the lower portion of the gear train.
Figure 6:
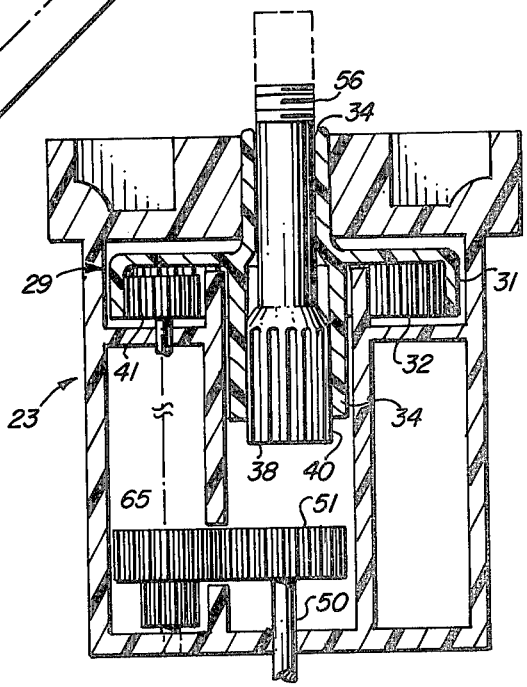
FIG. 6 is a longitudinal section through the gear housing.

Referring now more particularly to FIG. 5, the lower portion of the reduction gear train will be described. The gear train is designated generally 64. As shown in FIG. 5, gear 51 meshes with a gear 65 with which a pinion 66 is integral. Pinion 66 meshes with gear 67 which in turn meshes with gear 68. Gear 68 carries a pinion 69 which meshes with a gear 70 which carries a pinion 71. From pinion 71 an arrangement of gears and pinions extend to gear 41. This series of gears and pinions are mounted on parallel shafts.

THE OPERATION

While the mode of operation and manner of using the above-described pop-up swimming pool cleaner are believed to be obvious from the illustrations of the drawings and description of parts set forth above, they are briefly outlined as follows.

Water under pressure from conduit 19 passes through screen 15 and enters tangential inlets 47 from which they impinge under pressure onto impeller blades 49 to rotate the impeller and gear 51. Gear 51 through gear train 64 rotates gear 41 at a low rate as compared to the speed of rotation of impeller 48. Gear 41 meshes with ring gear 32 to rotate rotor 29. Thus, tube 36 is rotated as is jet block 55. Water from turbine casing 45 passes upwardly through openings 44 into duct 27. From the latter, some of the water engages the lower end of part 38 of tube 36 to force the latter upwardly until shoulder 39 engages shoulder 35. When this occurs, jet block 55 will be elevated to the broken-line position of FIG. 3.

A portion of the water in duct 27 passes through orifice 28 and about the various gears making up the gear train for lubricating purposes.

Just about all of the elements of the above-described mechanism are of plastic which is particularly adapted to have water come into contact therewith without any deleterious results.

While a preferred embodiment of the subject pop-up swimming pool cleaner has been disclosed, it is to be clearly understood that the invention is not to be limited to the exact construction, mechanisms, and devices illustrated and described because various modifications of these details may be provided in putting the invention into practice.

What is claimed is:

1. For installation in a swimming pool having a floor formed with a circular opening, a pop-up cleaner comprising the following elements, substantially all of which are of plastic:

(a) a nipple secured in position in said opening and depending from said floor and having a bore communicating with a source of water under pressure;

(b) a disk secured in position in said bore and constituting the upper end of a gear housing;

(c) said gear housing including a cylindrical wall, a bottom wall, a top wall and a central duct;

(d) a rotor rotatably mounted in said top wall depending from said top wall and including an internally toothed ring gear;

(e) a tube axially movable in said rotor and communicating with said water under pressure;

(f) means for establishing a driving relation between said rotor and said tube;

(g) a jet block positioned in the bore of said nipple above the top wall of said gear housing having a cylindrical surface and formed with an L-shaped passage opening onto said cylindrical surface and communicating with said tube;

(h) means for limiting axial movement of said tube relative to said rotor;

(i) a turbine casing secured to said bottom wall of the gear housing and including a cylindrical wall formed with water inlets communicating with said water under pressure;

(j) an impeller within said casing and drivably mounted on a shaft journaled in said bottom wall;

(k) a gear drivably mounted on the other end of said shaft;

(l) a reduction gear train having one end connected to said gear and the other end to said ring gear;

(m) said source of water under pressure communicating with the space about said turbine casing, whereby water pressure rotates the jet block through a full 360 degrees, delivers a jet stream from the open end of the passage in the jet block, and elevates said jet block into a position in which the jet stream is above the surface of the pool floor; and (n) a compression spring interposed between said jet block and the top wall of said gear housing for normally maintaining said jet block and said top wall spaced apart and preventing jamming when said jet block and said rotor are lowered under gravity action when said water under pressure is discontinued.

* * * * *